US009953507B1

(12) United States Patent
Smith

(10) Patent No.: US 9,953,507 B1
(45) Date of Patent: Apr. 24, 2018

(54) MONITORING A WEARING OF A WEARABLE DEVICE

(71) Applicant: Nortek Security & Control LLC, Carlsbad, CA (US)

(72) Inventor: Bruce Turner Smith, Carlsbad, CA (US)

(73) Assignee: Nortek Security & Control LLC, Carlsbad, CA (US)

( * ) Notice: Subject to any disclaimer, the term of this patent is extended or adjusted under 35 U.S.C. 154(b) by 0 days.

(21) Appl. No.: 15/393,142

(22) Filed: Dec. 28, 2016

(51) Int. Cl.
*G08B 21/04* (2006.01)
*G08B 25/01* (2006.01)

(52) U.S. Cl.
CPC ..... *G08B 21/0446* (2013.01); *G08B 25/016* (2013.01)

(58) Field of Classification Search
CPC ..... G08B 21/0446; G08B 25/016
USPC ..... 340/539.11
See application file for complete search history.

(56) References Cited

U.S. PATENT DOCUMENTS 9,685,097 B2 * 6/2017 Hoover ..... G09B 19/0092
9,835,644 B2 * 12/2017 Ten Kate ..... G01P 7/00
2011/0201972 A1 * 8/2011 Ten Kate ..... G08B 21/0446 600/595
2012/0101770 A1 * 4/2012 Grabiner ..... A61B 5/1116 702/141
2016/0038061 A1 * 2/2016 Kechichian ..... A61B 5/4035 600/301
2016/0078739 A1 * 3/2016 Burton ..... G08B 21/0446 340/539.11
2017/0061766 A1 * 3/2017 Gu ..... G08B 21/0446
2017/0109990 A1 * 4/2017 Xu ..... G08B 21/043
2017/0148297 A1 * 5/2017 Ross ..... G08B 21/043
2017/0200359 A1 * 7/2017 Gregg ..... G08B 21/043
2017/0322676 A1 * 11/2017 Li ..... G06F 3/0425

* cited by examiner

*Primary Examiner* — Hirdepal Singh
(74) *Attorney, Agent, or Firm* — Schwegman Lundberg & Woessner, P.A.

(57) ABSTRACT

A device for determining whether a user is wearing a wearable monitoring device is disclosed. The wearable monitoring device includes an accelerometer and a processor. The accelerometer detects a three-dimensional motion of the monitoring device and generates accelerometer data for each axis corresponding to the three-dimensional motion. The wearable monitoring device accesses the accelerometer data, detects a presence of a rhythmic pulse in one or more axes of the accelerometer data, and determines that the user is wearing the monitoring device in response to detecting the presence of the rhythmic pulse in the one or more axes.

20 Claims, 4 Drawing Sheets

MONITORING A WEARING OF A WEARABLE DEVICE

TECHNICAL FIELD

This application relates generally to a wearable monitoring device, and, in an example embodiment, to a method for determining whether the wearable monitoring device is being worn by a user.

BACKGROUND

For many elderly individuals and other individuals with physical disadvantages, the propensity to fall and the risk of injury therefrom increases over time. According to U.S. health statistics, one out of three adults age 65 and older falls each year, and these fall events are a leading cause of injury and death for this age segment. Falls are the most common cause of injuries and hospital admissions for trauma such as lacerations, hip fractures, and head trauma. Serious injury due to a fall may prevent a person from immediately contacting medical personnel or a caregiver, thereby exacerbating the injuries suffered.

In response to this problem, personal emergency reporting systems have evolved. Conventional personal emergency reporting systems sometimes take the form of an apparatus that a user keeps on his or her person and that includes a help button or switch that is pressed to alert others of a fall that requires help. The device may be worn on the wrist, attached to a belt, or carried in a pocket or purse, for example. However, depending on the severity of the injury, the user may not be able to reach and/or push the help button. For this reason, personal emergency reporting systems (PERS) with embedded fall detection technology in their transmitters have evolved.

A PERS device with embedded fall detection technology is won by a user and has a fall detection sensor that incorporates an accelerometer to record input data that is then processed to determine the probability of a fall event. Upon determining based on the sensor data that a fall event has likely occurred, the PERS device automatically initiates and transmits an alarm event to a predetermined central monitoring station or call center, typically via a PERS home console.

False positive fall detections are a significant problem with such systems. To help avoid false detections, the best location for the detection apparatus is on the user's torso, such as by being attached to a belt. However, users prefer a detection apparatus that is configured as a necklace. In conventional necklace-type detection systems, the fall detection apparatus, along with a battery, is embedded within a pendant that is fastened to a lanyard (necklace) and worn around the neck. As many fall detection devices incorporate an accelerometer, a challenge with having a fall detection device is the high probability of a false positive fall detection due to excessive movement or swaying of the pendant while not being worn by the user. For example, the pendant may be taken off and inadvertently hit an object such as a table or chair as the user puts it down. Such an impact may generate a false positive fall detection in a device configured to detect a shock as a fall event.

BRIEF DESCRIPTION OF THE DRAWINGS

The present embodiments are illustrated by way of example, and not by way of limitation, in the figures of the accompanying drawings.

DETAILED DESCRIPTION

Figure 1:
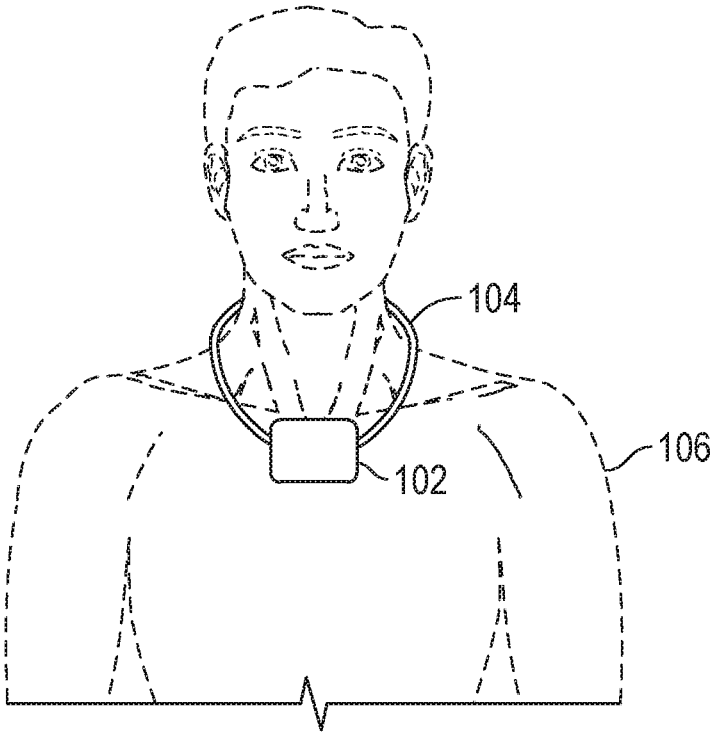
FIG. 1 is a diagram illustrating an example embodiment of a wearable monitoring device worn around a neck of a user.

Although the present disclosure has been described with reference to specific example embodiments, it will be evident that various modifications and changes may be made to these embodiments without departing from the broader spirit and scope of the disclosure. Accordingly, the specification and drawings are to be regarded in an illustrative rather than a restrictive sense.

An accelerometer in a wearable monitoring device such as a pendant, worn on a neck lanyard by a user, monitors acceleration in three-dimensional axes. The accelerometer is sensitive to detect the wearer's heartbeat and respiration. The presence of the heartbeat can be used to determine if the pendant is being worn by the user at any given time. This determination can be used as a filter to eliminate some false positives or to save power.

Fall detection devices already have accelerometers to determine the conditions of a fall. The presently described method uses the existing accelerometer in the fall detector to further classify an event as a true fall (unit is being worn) vs. a false alarm (unit is not being worn). This can significantly reduce false alarms with no added hardware or cost.

For example, one of the common false alarms for fall detection is when a pendant is being removed from being worn, and is placed in a charger, or dropped onto a table or bed. This action is often incorrectly detected as a fall. The presently described method can be used after a fall detection to qualify an alarm, by determining if the pendant is being worn or not. In this way, a false fall detection alarm can be prevented.

In one example embodiment, the presence of a heartbeat appears as a sinusoidal pulse that decays before the next heartbeat. Thus, a rhythmic pulse can be distinguished from background vibration that may be of mechanical origin. Another advantage of the presently described method for use in wearable devices is the potential for placing a device into low-power mode for battery savings when the device is not being worn.

In various embodiments, a wearable monitoring device determines whether a user is wearing the wearable monitoring device. The wearable monitoring device includes an accelerometer and a processor. The accelerometer detects a three-dimensional motion of the monitoring device and generates accelerometer data for each axis corresponding to the three-dimensional motion. The wearable monitoring device accesses the accelerometer data, detects a presence of a rhythmic pulse in one or more axes of the accelerometer data, and determines that the user is wearing the monitoring device in response to detecting the presence of the rhythmic pulse in the one or more axes.

In one example embodiment, the monitoring device sends, using a transceiver, a first message to a monitoring system in response to determining that the user is wearing the monitoring device. The monitoring device sends, using the transceiver, a second message to the monitoring system in response to determining that the user is not wearing the monitoring device.

In another example embodiment, the monitoring device detects a presence of a sinusoidal pulse that decays before a next sinusoidal pulse along the one or more axes and determines whether the user is wearing the monitoring device in response to detecting the presence of the sinusoidal pulse.

In another example embodiment, the monitoring device detects a fall based on the accelerometer data; determines that the fall is positive in response to determining that the user is wearing the monitoring device; and sends, using the transceiver, an alert message identifying the fall to the monitoring system.

In another example embodiment, the monitoring device detects a fall of the monitoring device in response to the accelerometer data exceeding a preset threshold and determines that the fall is a false positive in response to determining that the user is not wearing the monitoring device.

In another example embodiment, the monitoring device prevents a fall detection application in the processor from sending an alert message identifying a fall of the monitoring device.

In another example embodiment, the monitoring device detects a fall of the monitoring device in response to the accelerometer data exceeding a preset threshold. The monitoring device determines that the monitoring device was not being worn by the user prior to the detection of the fall. The monitoring device determines that the fall of the monitoring device is a false positive in response to determining that the monitoring device was not being worn by the user prior to the detection of the fall.

In another example embodiment, the monitoring device detects a fall of the monitoring device in response to the accelerometer data exceeding a preset threshold, determines that the monitoring device was being worn by the user prior to the detection of the fall and after the detection of the fall, and determines that the fall of the monitoring device is positive in response to determining that the monitoring device was being worn by the user prior to the detection of the fall and after the detection of the fall.

In another example embodiment, the monitoring device includes an audio or visual indicator configured to generate a signal in response to detecting a fall based on the accelerometer data and determining that the fall is positive in response to determining that the user is wearing the monitoring device.

In another example embodiment, the monitoring device includes a biometric sensor configured to determine whether the monitoring device is being worn by the user. The biometric sensor operates in combination with the accelerometer to identify a false positive of a fall of the monitoring device.

FIG. 1 is a diagram illustrating an example embodiment of a wearable monitoring device 102 worn around a neck of a user. The wearable monitoring device 102 is worn around the neck of a user 106 with a lanyard 104. The wearable monitoring device 102 rests against the user's 106 neck or chest while the wearable monitoring device 102 is suspended and hangs below the neck by the lanyard 104.

Figure 2:
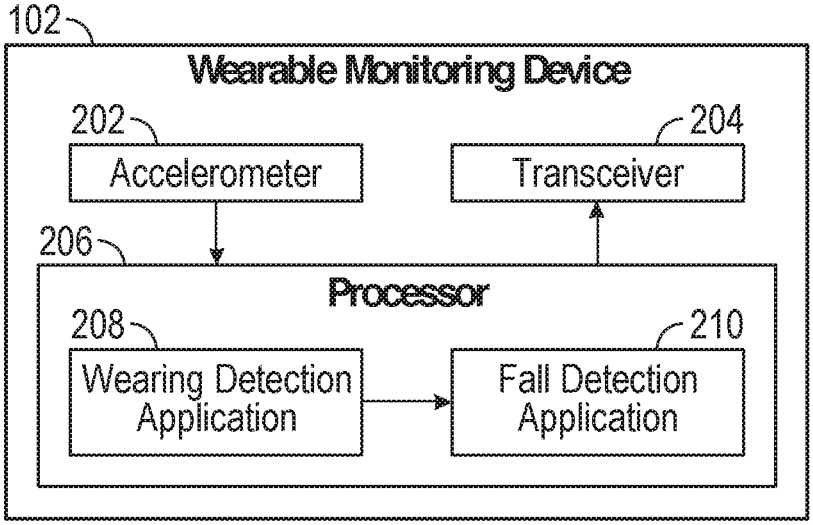
FIG. 2 is a block diagram illustrating an example embodiment of a wearable monitoring device.

FIG. 2 is a block diagram illustrating an example embodiment of a wearable monitoring device 102. The wearable monitoring device 102 includes a motion sensor (e.g., an accelerometer 202, a gyroscope, a magnetometer, an altimeter, or a combination thereof for detecting motion). A processor 206 processes signals from the accelerometer 202 to determine whether a fall event has occurred and whether the wearable monitoring device 102 is being worn. A transceiver 204 transmits fall detection alarms generated by the processor 206 via an antenna to a personal emergency reporting system (PERS) home console. The PERS home console then transmits an alert notification on to a central monitor station.

In one example embodiment, the processor 206 includes a wearing detection application 208 and a fall detection application 210. The wearing detection application 208 accesses the sensor data from the accelerometer 202 to identify rhythmic or pulsing patterns in one or more axes. Examples of rhythmic or pulsing patterns are further illustrated in FIGS. 6 and 7. In one example, a sampling of X-axis accelerometer data is examined to determine whether a sinusoidal pulse that decays before the next sinusoidal pulse is present. If the X axis does not include any sinusoidal pulse, the wearing detection application 208 examines the Y axis, and then the Z axis. If the periodic sinusoidal pulse is not present in any of the X, Y, and Z axes, the wearing detection application 208 determines that the wearable monitoring device 102 is not being worn by a user. If the periodic sinusoidal pulse is present in any of the X, Y, or Z axes, the wearing detection application 208 determines that the wearable monitoring device 102 is being worn by the user. In another example, the wearing detection application 208 compares and correlates the periodic sinusoidal pulse from one axis to the periodic sinusoidal pulse from another axis for further verification. The wearing detection application 208 verifies that the frequency of periodic sinusoidal pulses from one axis matches the frequency of periodic sinusoidal pulses from another axis to determine that the wearable monitoring device 102 is being worn by the user.

The fall detection application 210 detects a fall event based on an acceleration profile of the motion sensor. For example, a fall event is detected when the sensor data shows that acceleration exceeds a preset threshold or matches a preset pattern. When the fall detection application 210 detects a fall, the fall detection application 210 checks with the wearing detection application 208 to determine whether the wearable monitoring device 102 is being worn by the user prior to triggering an alarm or notification associated with the fall event. In other words, the fall event can be voided by the wearing detection application 208 if the wearing detection application 208 detects that the wearable monitoring device 102 is not being worn by the user.

Figure 3:
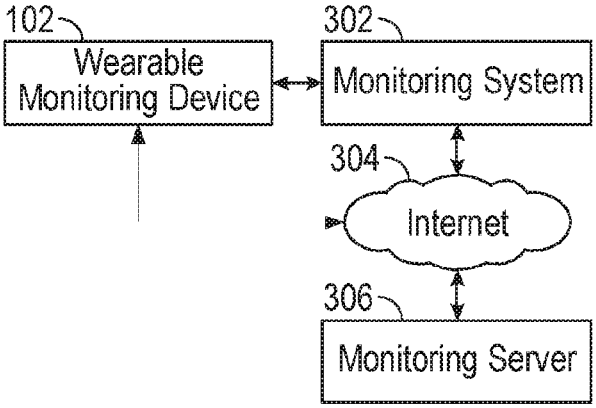
FIG. 3 is a block diagram illustrating an example embodiment of a network environment for operating a wearable monitoring device.

FIG. 3 is a block diagram illustrating an example embodiment of a network environment for operating a wearable monitoring device 102. The wearable monitoring device 102 transmits a fall detection alarm via the transceiver 204 (via wired or wireless means) to a monitoring system 302 (e.g., a personal emergency reporting system home console). The monitoring system 302, in turn, communicates with a monitoring server 306 (e.g., a central monitor station) via a communication network 304 (e.g., the Internet). In another example embodiment, the monitoring system 302 functionality could be contained within the wearable device itself, such as a mobile PERS device, which is cellular enabled and does not require a console.

Figure 4:
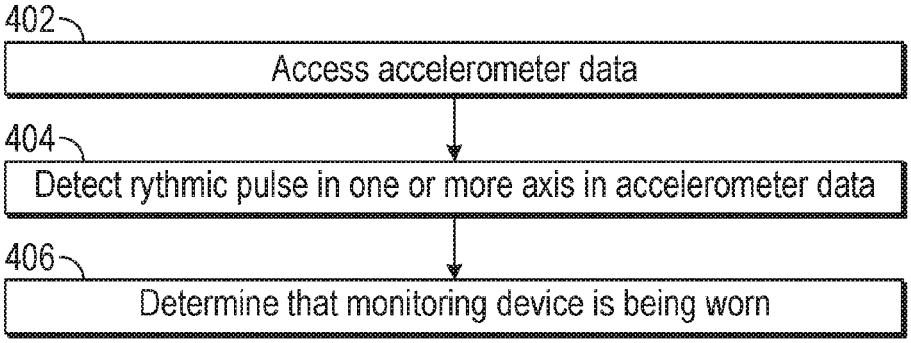
FIG. 4 is a flow diagram illustrating an example embodiment of a method of operating a wearable monitoring device.

FIG. 4 is a flow diagram illustrating an example embodiment of a method of operating a wearable monitoring device. At operation 402, the wearing detection application 208 accesses accelerometer data from the accelerometer 202. At operation 404, the wearing detection application 208 detects a rhythmic pulse in one or more axes in the accelerometer data. For example, the wearing detection application 208 detects the heartbeat of the user but does not measure the heart rate itself. At operation 406, the wearing detection application 208 determines whether the wearable monitoring device 102 is being worn by the user based on the presence of the detected heartbeat of the user.

Figure 5:
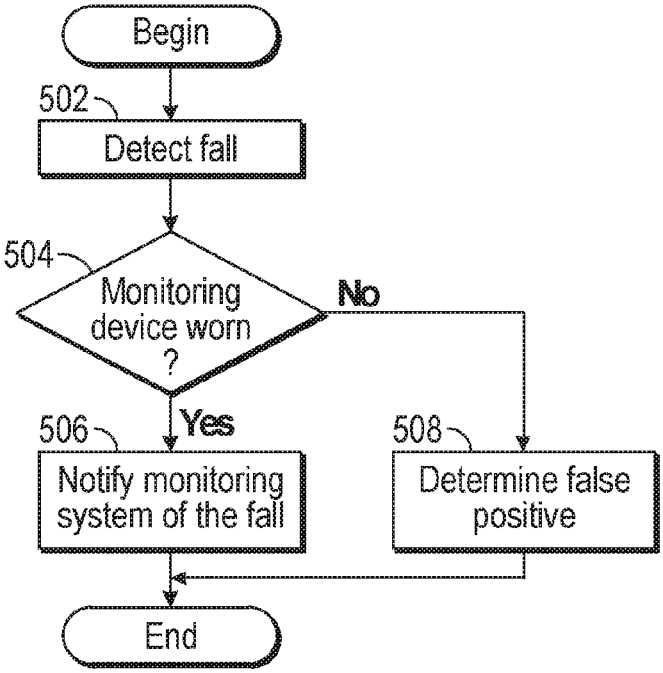
FIG. 5 is a flow diagram illustrating an example embodiment of a method of operating a wearable monitoring device.

FIG. 5 is a flow diagram illustrating an example embodiment of a method of operating a wearable monitoring device. At operation 502, the fall detection application 210 detects a fall event based the accelerometer data matching preset fall detection ranges or patterns. At operation 504, the wearing detection application 208 detects whether the wearable monitoring device 102 is being worn by the user. At operation 506, if the wearing detection application 208 detects that the wearable monitoring device 102 is being worn by the user, the wearing detection application 208 allows the fall detection application 210 to proceed with generating an alarm signal and notifying a remote monitoring system of the fall. At operation 508, if the wearing detection application 208 detects that the wearable monitoring device 102 is not being worn by the user, the wearing detection application 208 prevents the fall detection application 210 from notifying the remote monitoring system of the fall. In another example embodiment, the fall detection application 210 still generates a fall detection signal. However, the wearing detection application 208 prevents the fall detection application 210 from sending the fall detection signal to the monitoring system 302.

Figure 6:
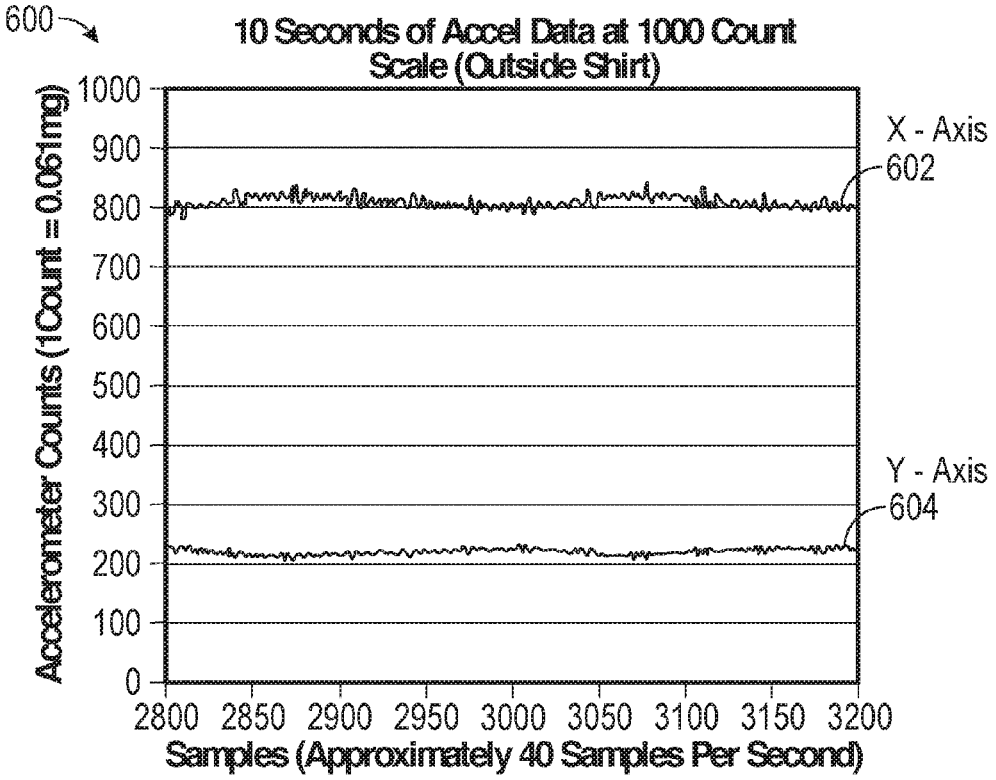
FIG. 6 is an example of an acceleration profile detected using the wearable monitoring device of FIG. 2.

FIG. 6 is an example of an acceleration profile 600 detected using the wearable monitoring device of FIG. 2. The acceleration profile 600 includes a graph 602 of counts along an X axis and a graph 604 of counts along a Y axis.

Figure 7:
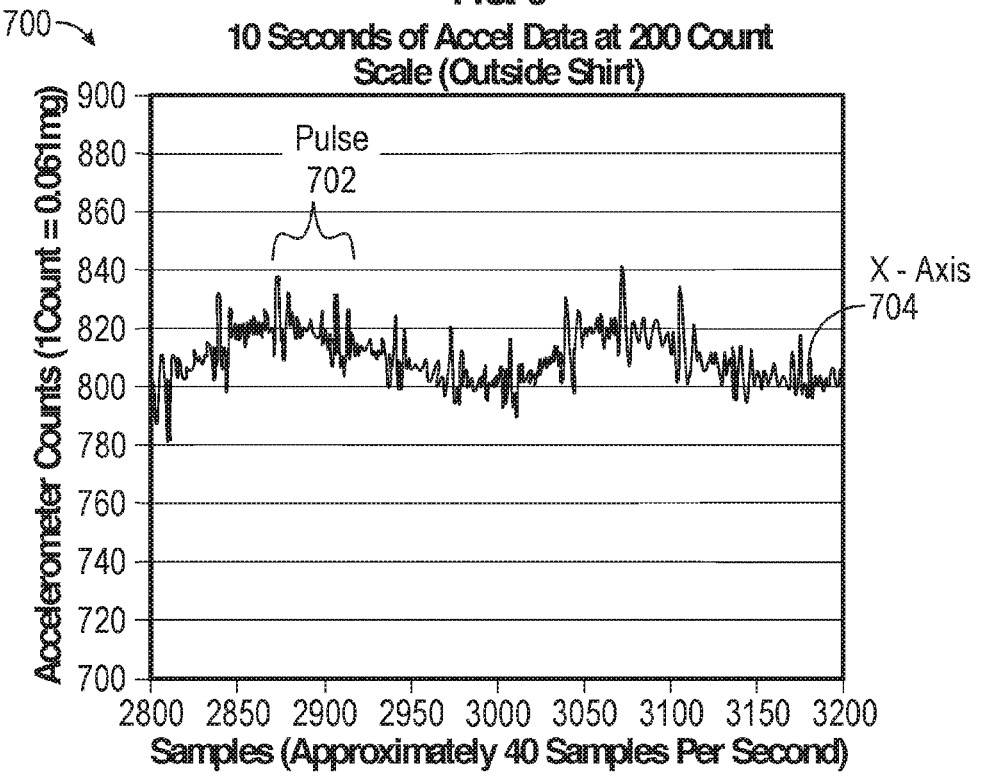
FIG. 7 is an example of an acceleration profile detected using the wearable monitoring device of FIG. 2.

FIG. 7 is an example of an acceleration profile 700 detected using the wearable monitoring device of FIG. 2. The acceleration profile 700 includes a graph 704 of counts along an X axis. A pulse 702 is identified on the acceleration profile 700.

Modules, Components and Logic

Certain embodiments are described herein as including logic or a number of components, modules, or mechanisms. Modules may constitute either software modules (e.g., code embodied on a machine-readable medium or in a transmission signal) or hardware modules. A hardware module is a tangible unit capable of performing certain operations and may be configured or arranged in a certain manner. In example embodiments, one or more computer systems (e.g., a standalone, client, or server computer system) or one or more hardware modules of a computer system (e.g., a processor or a group of processors) may be configured by software (e.g., an application or application portion) as a hardware module that operates to perform certain operations as described herein.

In various embodiments, a hardware module may be implemented mechanically or electronically. For example, a hardware module may comprise dedicated circuitry or logic that is permanently configured (e.g., as a special-purpose processor, such as a field-programmable gate array (FPGA) or an application-specific integrated circuit (ASIC)) to perform certain operations. A hardware module may also comprise programmable logic or circuitry (e.g., as encompassed within a general-purpose processor or other programmable processor) that is temporarily configured by software to perform certain operations. It will be appreciated that the decision to implement a hardware module mechanically, in dedicated and permanently configured circuitry, or in temporarily configured circuitry (e.g., configured by software) may be driven by cost and time considerations.

Accordingly, the term "hardware module" should be understood to encompass a tangible entity, be that an entity that is physically constructed, permanently configured (e.g., hardwired), or temporarily configured (e.g., programmed) to operate in a certain manner and/or to perform certain operations described herein. Considering embodiments in which hardware modules are temporarily configured (e.g., programmed), each of the hardware modules need not be configured or instantiated at any one instance in time. For example, where the hardware modules comprise a general-purpose processor configured using software, the general-purpose processor may be configured as respective different hardware modules at different times. Software may accordingly configure a processor, for example, to constitute a particular hardware module at one instance of time and to constitute a different hardware module at a different instance of time.

Hardware modules can provide information to, and receive information from, other hardware modules. Accordingly, the described hardware modules may be regarded as being communicatively coupled. Where multiple of such hardware modules exist contemporaneously, communications may be achieved through signal transmission (e.g., over appropriate circuits and buses that connect the hardware modules). In embodiments in which multiple hardware modules are configured or instantiated at different times, communications between or among such hardware modules may be achieved, for example, through the storage and retrieval of information in memory structures to which the multiple hardware modules have access. For example, one hardware module may perform an operation and store the output of that operation in a memory device to which it is communicatively coupled. A further hardware module may then, at a later time, access the memory device to retrieve and process the stored output. Hardware modules may also initiate communications with input or output devices and can operate on a resource (e.g., a collection of information).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions. The modules referred to herein may, in some example embodiments, comprise processor-implemented modules.

Similarly, the methods described herein may be at least partially processor-implemented. For example, at least some of the operations of a method may be performed by one or more processors or processor-implemented modules. The performance of certain of the operations may be distributed among the one or more processors, not only residing within a single machine, but deployed across a number of machines. In some example embodiments, the processor or processors may be located in a single location (e.g., within a home environment, an office environment, or a server farm), while in other embodiments the processors may be distributed across a number of locations.

The one or more processors may also operate to support performance of the relevant operations in a "cloud computing" environment or as a "software as a service" (SaaS). For example, at least some of the operations may be performed by a group of computers (as examples of machines including processors), these operations being accessible via the communication network 304 and via one or more appropriate interfaces (e.g., application programming interfaces (APIs)).

Electronic Apparatus and System

Example embodiments may be implemented in digital electronic circuitry, in computer hardware, firmware, or software, or in combinations of them. Example embodiments may be implemented using a computer program product, e.g., a computer program tangibly embodied in an information carrier, e.g., in a machine-readable medium for execution by, or to control the operation of, data processing apparatus, e.g., a programmable processor, a computer, or multiple computers.

A computer program can be written in any form of programming language, including compiled or interpreted languages, and it can be deployed in any form, including as a standalone program or as a module, subroutine, or other unit suitable for use in a computing environment. A computer program can be deployed to be executed on one computer or on multiple computers at one site or distributed across multiple sites and interconnected by a communication network 304.

In example embodiments, operations may be performed by one or more programmable processors executing a computer program to perform functions by operating on input data and generating output. Method operations can also be performed by, and apparatus of example embodiments may be implemented as, special purpose logic circuitry (e.g., an FPGA or an ASIC).

A computing system can include clients and servers. A client and server are generally remote from each other and typically interact through a communication network 304. The relationship of client and server arises by virtue of computer programs running on the respective computers and having a client-server relationship to each other. In embodiments deploying a programmable computing system, it will be appreciated that both hardware and software architectures merit consideration. Specifically, it will be appreciated that the choice of whether to implement certain functionality in permanently configured hardware (e.g., an ASIC), in temporarily configured hardware (e.g., a combination of software and a programmable processor), or in a combination of permanently and temporarily configured hardware may be a design choice. Below are set out hardware (e.g., machine) and software architectures that may be deployed, in various example embodiments.

Example Machine Architecture

Figure 8:
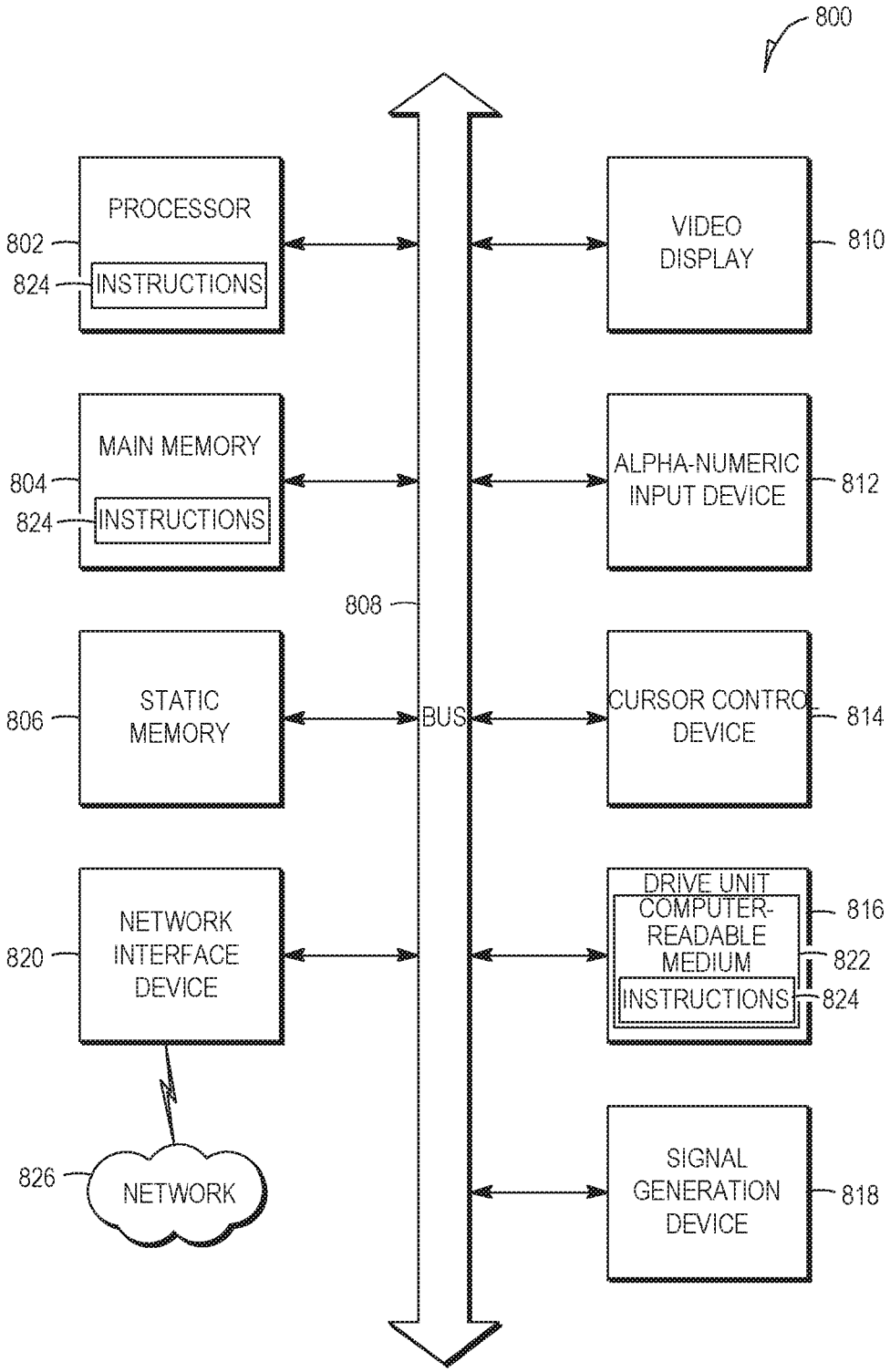
FIG. 8 shows a diagrammatic representation of a machine in the example form of a computer system within which a set of instructions may be executed to cause the machine to perform any one or more of the methodologies discussed herein.

FIG. 8 is a block diagram of a machine in the example form of a computer system 800 within which instructions 824 for causing the machine to perform any one or more of the methodologies discussed herein may be executed. In alternative embodiments, the machine operates as a standalone device or may be connected (e.g., networked) to other machines. In a networked deployment, the machine may operate in the capacity of a server or a client machine in a server-client network environment, or as a peer machine in a peer-to-peer (or distributed) network environment. The machine may be a personal computer (PC), a tablet PC, a set-top box (STB), a personal digital assistant (PDA), a cellular telephone, a web appliance, a network router, a network switch, a network bridge, or any machine capable of executing the instructions 824 (sequential or otherwise) that specify actions to be taken by that machine. Further, while only a single machine is illustrated, the term "machine" shall also be taken to include any collection of machines that individually or jointly execute a set (or multiple sets) of instructions 824 to perform any one or more of the methodologies discussed herein.

The example computer system 800 includes a processor 802 (e.g., a central processing unit (CPU), a graphics processing unit (GPU), or both), a main memory 804, and a static memory 806, which communicate with each other via a bus 808. The computer system 800 may further include a video display unit 810 (e.g., a liquid crystal display (LCD) or a cathode ray tube (CRT)). The computer system 800 also includes an alphanumeric input device 812 (e.g., a keyboard), a user interface (UI) navigation (or cursor control) device 814 (e.g., a mouse), a disk drive unit 816, a signal generation device 818 (e.g., a speaker), and a network interface device 820.

Machine-Readable Medium

The disk drive unit 816 includes a computer-readable medium 822 on which is stored one or more sets of data structures and instructions 824 (e.g., software) embodying or utilized by any one or more of the methodologies or functions described herein. The instructions 824 may also reside, completely or at least partially, within the main memory 804 and/or within the processor 802 during execution thereof by the computer system 800, the main memory 804 and the processor 802 also constituting computer-readable media 822. The instructions 824 may also reside, completely or at least partially, within the static memory 806.

While the computer-readable medium 822 is shown, in an example embodiment, to be a single medium, the term "machine-readable medium" may include a single medium or multiple media (e.g., a centralized or distributed database, and/or associated caches and servers) that store the one or more instructions 824 or data structures. The term "computer-readable medium" shall also be taken to include any tangible medium that is capable of storing, encoding; or carrying the instructions 824 for execution by the machine and that cause the machine to perform any one or more of the methodologies of the present embodiments, or that is capable of storing, encoding, or carrying data structures utilized by or associated with such instructions 824. The term "computer-readable medium" shall accordingly be taken to include, but not be limited to, solid-state memories, and optical and magnetic media. Specific examples of computer-readable media 822 include non-volatile memory, including by way of example semiconductor memory devices (e.g., erasable programmable read-only memory (EPROM), electrically erasable programmable read-only memory (EEPROM), and flash memory devices); magnetic disks such as internal hard disks and removable disks; magneto-optical disks; and compact disc-read-only memory (CD-ROM) and digital versatile disc (or digital video disc) read-only memory (DVD-ROM) disks.

Transmission Medium

The instructions 824 may further transmitted or received over a communication network 826 using a transmission medium. The instructions 824 may be transmitted using the network interface device 820 and any one of a number of well-known transfer protocols (e.g., hypertext transfer protocol (HTTP)). Examples of communication networks 826 include a local-area network (LAN), a wide-area network (WAN), the Internet, mobile telephone networks, plain old telephone service (POTS) networks, and wireless data networks (e.g., Wi-Fi and WiMAX networks). The term "transmission medium" shall be taken to include any intangible medium capable of storing, encoding, or carrying the instructions 824 for execution by the machine, and includes digital or analog communications signals or other intangible media to facilitate communication of such software.

Although an embodiment has been described with reference to specific example embodiments, it will be evident that various modifications and changes may be made to these embodiments without departing from the scope of the present disclosure. Accordingly, the specification and drawings are to be regarded in an illustrative rather than a restrictive sense. The accompanying drawings that form a part hereof show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled.

Such embodiments of the inventive subject matter may be referred to herein, individually and/or collectively, by the term "invention" merely for convenience and without intending to voluntarily limit the scope of this application to any single invention or inventive concept if more than one is in fact disclosed. Thus, although specific embodiments have been illustrated and described herein, it should be appreciated that any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

The following enumerated embodiments describe various example embodiments of a wearable monitoring device discussed herein.

A first embodiment provides a monitoring device comprising:

an accelerometer configured to detect a three-dimensional motion of the monitoring device configured to be worn by a user and to generate accelerometer data for each axis corresponding to the three-dimensional motion;

a transceiver configured to communicate with a monitoring system via a radio signal; and a processor configured to perform operations comprising:

accessing the accelerometer data;

detecting a presence of a rhythmic pulse in one or more axes; and determining whether the user is wearing the monitoring device in response to detecting the presence of the rhythmic pulse in the one or more axes.

A second embodiment provides a device according to the first embodiment, wherein the operations further comprise:

sending, using the transceiver, a first message to the monitoring system in response to determining that the user is wearing the monitoring device; and sending, using the transceiver, a second message to the monitoring system in response to determining that the user is not wearing the monitoring device.

A third embodiment provides a device according to the first embodiment, wherein the operations further comprise:

detecting a presence of a sinusoidal pulse that decays before a next sinusoidal pulse along the one or more axes; and determining whether the user is wearing the monitoring device in response to detecting the presence of the sinusoidal pulse.

A fourth embodiment provides a device according to the first embodiment, wherein the operations further comprise:

detecting a fall based on the accelerometer data;

determining that the fall is positive in response to determining that the user is wearing the monitoring device; and sending, using the transceiver, an alert message identifying the fall to the monitoring system.

A fifth embodiment provides a device according to the first embodiment, wherein the operations further comprise:

detecting a fall of the monitoring device in response to the accelerometer data exceeding a preset threshold; and determining that the fall is a false positive in response to determining that the user is not wearing the monitoring device.

A sixth embodiment provides a device according to the fifth embodiment, wherein the operations further comprise:

preventing a fall detection application in the processor from sending an alert message identifying the fall of the monitoring device.

A seventh embodiment provides a device according to the first embodiment, wherein the operations further comprise:

detecting a fall of the monitoring device in response to the accelerometer data exceeding a preset threshold;

determining that the monitoring device was not being worn by the user prior to the detection of the fall; and determining that the fall of the monitoring device is a false positive in response to determining that the monitoring device was not being worn by the user prior to the detection of the fall.

An eighth embodiment provides a device according to the first embodiment, wherein the operations further comprise:

detecting a fall of the monitoring device in response to the accelerometer data exceeding a preset threshold;

determining that the monitoring device was being worn by the user prior to the detection of the fall and after the detection of the fall; and determining that the fall of the monitoring device is positive in response to determining that the monitoring device was being worn by the user prior to the detection of the fall and after the detection of the fall.

A ninth embodiment provides a device according to the first embodiment, wherein the operations further comprise:

an audio or visual indicator configured to generate a signal in response to detecting a fall based on the accelerometer data and determining that the fall is positive in response to determining that the user is wearing the monitoring device.

A tenth embodiment provides a device according to the first embodiment, wherein the operations further comprise:

a biometric sensor configured to determine whether the monitoring device is being worn by the user, the biometric sensor operating in combination with the accelerometer to identify a false positive of a fall of the monitoring device.

What is claimed is:

1. A monitoring device comprising:

an accelerometer configured to detect a three-dimensional motion of the monitoring device configured to be worn by a user and to generate accelerometer data for each axis corresponding to the three-dimensional motion;

a transceiver configured to communicate with a monitoring system via a radio signal; and a processor configured to perform operations comprising:

accessing the accelerometer data;

detecting a presence of a first rhythmic pulse along a first axis from the accelerometer data, and a second rhythmic pulse along a second axis from the accelerometer data;

determining that a first frequency of the first rhythmic pulse correlates with a second frequency of the second rhythmic pulse; and determining that the user is wearing the monitoring device in response to determining that the first frequency correlates with the second frequency.

2. The monitoring device of claim 1, wherein the operations further comprise:

sending, using the transceiver, a first message to the monitoring system in response to determining that the user is wearing the monitoring device; and sending, using the transceiver, a second message to the monitoring system in response to determining that the user is not wearing the monitoring device.

3. The monitoring device of claim 1, wherein the operations further comprise:

detecting a presence of a sinusoidal pulse that decays before a next sinusoidal pulse along the first axis; and determining whether the user is wearing the monitoring device in response to detecting the presence of the sinusoidal pulse.

4. The monitoring device of claim 1, wherein the operations further comprise:

detecting a fall based on the accelerometer data;

determining that the fall is positive in response to determining that the user is wearing the monitoring device; and sending, using the transceiver, an alert message identifying the fall to the monitoring system.

5. The monitoring device of claim 1, wherein the operations further comprise:

detecting a fall of the monitoring device in response to the accelerometer data exceeding a preset threshold; and determining that the fall is a false positive in response to determining that the user is not wearing the monitoring device.

6. The monitoring device of claim 5, wherein the operations further comprise:

preventing a fall detection application in the processor from sending an alert message identifying the fall of the monitoring device.

7. The monitoring device of claim 1, wherein the operations further comprise:

detecting a fall of the monitoring device in response to the accelerometer data exceeding a preset threshold;

determining that the monitoring device was not being worn by the user prior to the detection of the fall; and determining that the fall of the monitoring device is a false positive in response to determining that the monitoring device was not being worn by the user prior to the detection of the fall.

8. The monitoring device of claim 1, wherein the operations further comprise:

detecting a fall of the monitoring device in response to the accelerometer data exceeding a preset threshold;

determining that the monitoring device was being worn by the user prior to the detection of the fall and after the detection of the fall; and determining that the fall of the monitoring device is positive in response to determining that the monitoring device was being worn by the user prior to the detection of the fall and after the detection of the fall.

9. The monitoring device of claim 1, further comprising:

an audio or visual indicator configured to generate a signal in response to detecting a fall based on the accelerometer data and determining that the fall is positive in response to determining that the user is wearing the monitoring device.

10. The monitoring device of claim 1, further comprising:

a biometric sensor configured to determine whether the monitoring device is being worn by the user, the biometric sensor operating in combination with the accelerometer to identify a false positive of a fall of the monitoring device.

11. A method comprising:

detecting a three-dimensional motion of a monitoring device configured to be worn by a user;

generating accelerometer data for each axis corresponding to the three-dimensional motion;

detecting a presence of a first rhythmic pulse along a first axis from the accelerometer data, and a second rhythmic pulse along a second axis from the accelerometer data;

determining that a first frequency of the first rhythmic pulse correlates with a second frequency of the second rhythmic pulse;

determining that the user is wearing the monitoring device in response to determining that the first frequency correlates with the second frequency; and communicating a message with a monitoring system via a radio signal, the message identifying that the user is wearing the monitoring device in response to determining that the first frequency correlates with the second frequency.

12. The method of claim 11, further comprising:

sending a first message to the monitoring system in response to determining that the user is wearing the monitoring device; and sending a second message to the monitoring system in response to determining that the user is not wearing the monitoring device.

13. The method of claim 11, further comprising:

detecting a presence of a sinusoidal pulse that decays before a next sinusoidal pulse along the first axis; and determining whether the user is wearing the monitoring device in response to detecting the presence of the sinusoidal pulse.

14. The method of claim 11, further comprising:

detecting a fall based on the accelerometer data;

determining that the fall is positive in response to determining that the user is wearing the monitoring device; and sending an alert message identifying the fall to the monitoring system.

15. The method of claim 11, further comprising:

detecting a fall of the monitoring device in response to the accelerometer data exceeding a preset threshold; and determining that the fall is a false positive in response to determining that the user is not wearing the monitoring device.

16. The method of claim 15, further comprising:

preventing a fall detection application from sending an alert message identifying the fall of the monitoring device.

17. The method of claim 11, further comprising:

detecting a fall of the monitoring device in response to the accelerometer data exceeding a preset threshold;

determining that the monitoring device was not being worn by the user prior to the detection of the fall; and determining that the fall of the monitoring device is a false positive in response to determining that the monitoring device was not being worn by the user prior to the detection of the fall.

18. The method of claim 11, further comprising:

detecting a fall of the monitoring device in response to the accelerometer data exceeding a preset threshold;

determining that the monitoring device was being worn by the user prior to the detection of the fall and after the detection of the fall; and determining that the fall of the monitoring device is positive in response to determining that the monitoring device was being worn by the user prior to the detection of the fall and after the detection of the fall.

19. The method of claim 11, further comprising:

generating an audio or visual signal in response to detecting a fall based on the accelerometer data; and determining that the fall is positive in response to determining that the user is wearing the monitoring device.

20. A non-transitory computer-readable storage medium storing a set of instructions that, when executed by a processor, cause the processor to perform operations comprising:

detecting a three-dimensional motion of a monitoring device configured to be worn by a user;

generating accelerometer data for each axis corresponding to the three-dimensional motion;

detecting a presence of a first rhythmic pulse along a first axis from the accelerometer data, and a second rhythmic pulse along a second axis from the accelerometer data;

determining that a first frequency of the first rhythmic pulse correlates with a second frequency of the second rhythmic pulse;

determining that the user is wearing the monitoring device in response to determining that the first frequency correlates with the second frequency; and communicating a message with a monitoring system via a radio signal, the message identifying that the user is wearing the monitoring device in response to determining that the first frequency correlates with the second frequency.

* * * * *